US006301899B1

(12) United States Patent
Dean et al.

(10) Patent No.: US 6,301,899 B1
(45) Date of Patent: Oct. 16, 2001

(54) MIXER HAVING INTERVANE FUEL INJECTION

(75) Inventors: Anthony John Dean, Scotia; Steven George Goebel, Clifton Park, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/299,792

(22) Filed: Mar. 17, 1999

Related U.S. Application Data

(62) Division of application No. 08/818,465, filed on Mar. 17, 1997, now Pat. No. 5,899,075.

(51) Int. Cl.[7] ..... F02C 1/00
(52) U.S. Cl. ..... 60/737; 60/748
(58) Field of Search ..... 60/737, 748

(56) References Cited

U.S. PATENT DOCUMENTS

| | | | | |
|---|---|---|---|---|
| 4,426,841 | * | 1/1984 | Cornelius et al. | 60/39.23 |
| 5,351,477 | | 10/1994 | Joshi et al. | 60/39.463 |
| 5,435,126 | * | 7/1995 | Beaudoin | 60/39.463 |
| 5,778,676 | * | 7/1998 | Joshi et al. | 60/746 |
| 6,070,410 | * | 6/2000 | Dean | 60/737 |

* cited by examiner

*Primary Examiner*—Charles G. Freay
(74) *Attorney, Agent, or Firm*—Patrick K. Patnode; Douglas E. Stoner

(57) ABSTRACT

A mixer for a combustor includes a swirler having a plurality of vanes disposed at an upstream end of a mixing duct. A centerbody extends downstream from the vanes and includes a fuel chamber integrally joined to the vanes. Fuel injection openings extend from the chamber into passages between the vanes.

17 Claims, 3 Drawing Sheets

MIXER HAVING INTERVANE FUEL INJECTION

This application is a division of Ser. No. 08/818,465, filed Mar. 17, 1997 (now U.S. Pat. No. 5,899,075), issued May 4, 1999 (RD-24826) which is hereby incorporated by reference in its entirety.

BACKGROUND OF THE INVENTION

This invention relates generally to a combustor of a turbine engine and, more particularly, to a combustor premixer.

In a typical aero-derivative industrial gas turbine engine, fuel is burned in an annular combustor. The fuel is metered and injected into the combustor by multiple nozzles along with combustion air having a designated amount of swirl. Non-uniformity of the fuel/air mixture causes the flame to be locally hotter, leading to significantly enhanced production of NOx. As herein used, the term "fuel/air mixture" is defined as a mixture of air and fuel for combustion.

In the typical turbine engine, flame stability and engine operability dominate the combustor design requirements. These requirements have in general resulted in combustor designs with the combustion at the dome end of the combustor proceeding at the highest possible temperatures at stoichiometric conditions. Additionally, designs that optimize flame stability and engine operability typically do not minimize production of NOx.

To reduce the production of NOx, hollow vane mixers have been used for fuel injection. Such a mixer includes an outer annular swirler and an inner annular swirler. The outer annular swirler includes hollow vanes with internal cavities and gas fuel passages for injecting gas fuel into the air stream. Using such a mixer, the high pressure air and the fuel is uniformly mixed, resulting in reduced formation of pollutants when the fuel/air mixture is exhausted out the downstream end of the mixing duct into the combustor and ignited. Such hollow vanes are used in both single fuel and dual fuel mixers.

Although the above described mixer satisfies the technical requirements of very low emissions, the mixer is complex and costly to fabricate, particularly the hollow swirl vanes. The hollow vane fabrication process includes time-consuming, intricate machining processes which result in reduced manufacturing yield. Further, as compared to a solid vane swirler, the reliability of the hollow vane swirler is reduced due to the potential for cracking around the injection openings and in the vane walls.

It is desirable to reduce the cost and improve the reliability of mixers. Such a mixer, however, must maintain acceptable combustion performance and emission levels.

SUMMARY OF THE INVENTION

In accordance with the instant invention, a combustor comprises a hollow body defining a combustion chamber. The hollow body is typically annular in form and includes an outer liner, an inner liner, and an upstream dome plate. Mounted to the dome plate is a swirl cup with a mixer disposed therein to provide uniform mixing of fuel and air. The mixer comprises an inner swirler and an outer swirler that are mounted in the swirl cup. The outer swirler typically includes solid vanes. A shroud surrounds the mixer at the upstream end, which shroud includes an annular fuel chamber. The shroud further comprises a plurality of axial fuel injection openings that provide flow communication between the annular fuel chamber and the mixer and radially inject fuel within the mixer. The use of solid vanes within the combustor significantly reduces the fabrication time and costs associated with the mixer, and also significantly reduces the possibility for vane cracking, thereby improving the reliability of the mixer. In addition, by radially injecting fuel through axial fuel injection openings, the desired combustion performance and yield emissions of such a solid vane mixer are achieved.

DETAILED DESCRIPTION OF THE INVENTION

Figure 1:
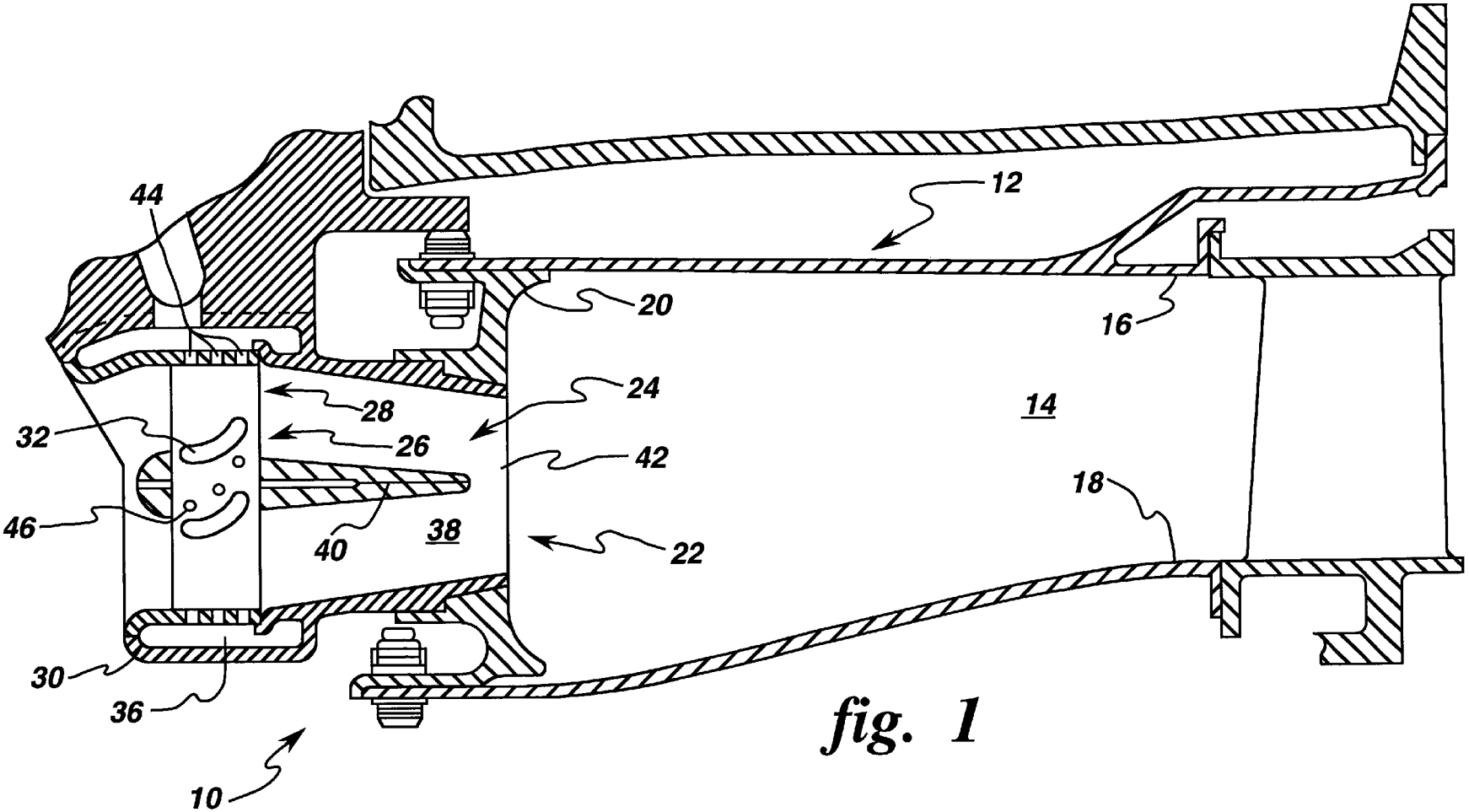
FIG. 1 is a cross-sectional view through a combustor structure in accordance with one embodiment of the instant invention.

A combustor 10 comprises a hollow body 12 defining a combustion chamber 14, as shown in FIG. 1. Hollow body 12 is typically annular in form and includes an outer liner 16, an inner liner 18, and an upstream dome plate 20. Dome plate 20 includes a swirl cup 22 with a mixer 24 disposed therein to provide uniform mixing of fuel and air.

In accordance with one embodiment of the instant invention, mixer 24 comprises a double swirler configuration including an inner swirler 26 (FIG. 2) and an outer swirler 28 (FIG. 2), which are mounted in swirl cup 22 (FIG. 1). Inner and outer swirlers 26, 28 typically are configured such the flow within each swirler is counter-rotating with respect to one another. Swirlers 28 and 26 typically have outer swirl vanes 32 and inner swirl vanes 34 respectively, each at an angle in the range between about 40° to about 60° with respect to a longitudinal axis "A" through the center of mixer 24. The ratio of air mass flowing in inner swirler 26 and in outer swirler 28 is typically about 1:3. This air mass ratio yields effective mixing of fuel and air (due to the above-mentioned counter-swirl) within the annular mixing duct and yet has sufficient residual swirl (corresponding to the higher air mass fraction of the outer swirlers) for adequate flame stability in the combustor.

A shroud 30 (FIG. 1) surrounds mixer 24 at the upstream end, shroud 30 including an annular fuel chamber 36. Downstream of inner and outer swirlers 26, 28 is an annular mixing duct 38. Annular mixing duct 38 can be either converging as shown in FIG. 1 or alternatively can be a straight cylindrical duct. (Not shown).

A centerbody 40 is provided in mixer 24, wherein centerbody 40 may be a straight cylindrical section or alternatively one in which the surfaces converge substantially uniformly (that is at a substantially uniform slope) from an upstream end to a downstream end.

Inner and outer swirlers 26, 28 are designed to pass a proportional amount of air flow, and annular fuel chamber 36 is sized to permit a proportional amount of fuel flow so as to result in a lean mixture at exit plane 42 of mixer 24. By "lean" it is meant that the fuel/air mixture contains more air then is required to fully combust the fuel, or an equivalence ratio of less than one. An equivalence ratio in the range between about 0.4 to about 0.7 is preferred. This equivalence ratio gives relatively low NOx emissions while satisfying the turbine inlet temperature and flame stability requirements.

Further details of a combustion apparatus such as combustor 10 are set forth in commonly assigned U.S. Pat. No. 5,351,477, which is herein incorporated by reference.

At least one and typically a plurality of axial fuel injection openings 44 are disposed in shroud 30 to provide flow communication between annular fuel chamber 36 and mixing duct 38. As shown in FIG. 1, three axial spaced fuel injection openings 44 are located in shroud 30 between outer swirl vanes 32. Axial distribution of fuel openings 44 increase injection points within a confined space. This axial distribution of fuel injection openings 44 is anticipated to provide improved combustion-driven pressure oscillations. Theoretically, axial distribution of fuel results in differing convective times for fuel to reach a burning zone so fuel-air wave gain is lower.

Fuel is injected radially inward from annular fuel chamber 36 through fuel injection openings 44 into the air flow within mixing duct 38. Conventional designs require pegs or hollow vanes to inject and distribute fuel into mixer 24. Axial fuel injection openings 44 do not hold flame and are therefore flashback resistant. This flashback resistance is an advantage over conventional fuel injection means. In conventional fuel pegs, for example, the fuel pegs delivering the fuel extend within the flow area. Accordingly, there are recirculation zones formed allowing flames to stabilize in the premixer.

In accordance with one embodiment of the instant invention, outer swirler 28 includes solid outer swirl vanes 32. Solid vanes are more reliable than conventional hollow vanes. One embodiment comprises ten outer swirl vanes 32 disposed on outer swirler 28, with about thirty axial located fuel injection openings 44 having a diameter of about 0.024 inches. In one embodiment, fuel injection openings 44 are located in fuel injection opening groups of three with the fuel injection opening groups substantially equally spaced around shroud 30. (See FIG. 1).

In one embodiment of the instant invention, fuel injection openings 44 are arranged in an angular relationship as superimposed on outer swirler 28 at 46. In this embodiment, fuel injection openings 44 of each fuel injection opening group are angularly displaced relative to each other fuel injection opening of the group. This configuration facilitates substantially uniform fuel injection from annular fuel chamber 36 through fuel injection openings 44. Of course, the size and placement of fuel injection openings 44 can be optimized depending on the desired emissions and engine load range. Due to the differing momentum ratios associated with fuel jets from different sized holes, the fuel-air mean profile can be manipulated for best performance, which is a combination of emissions, lean blow out, combustor noise and turn down.

Figure 2:
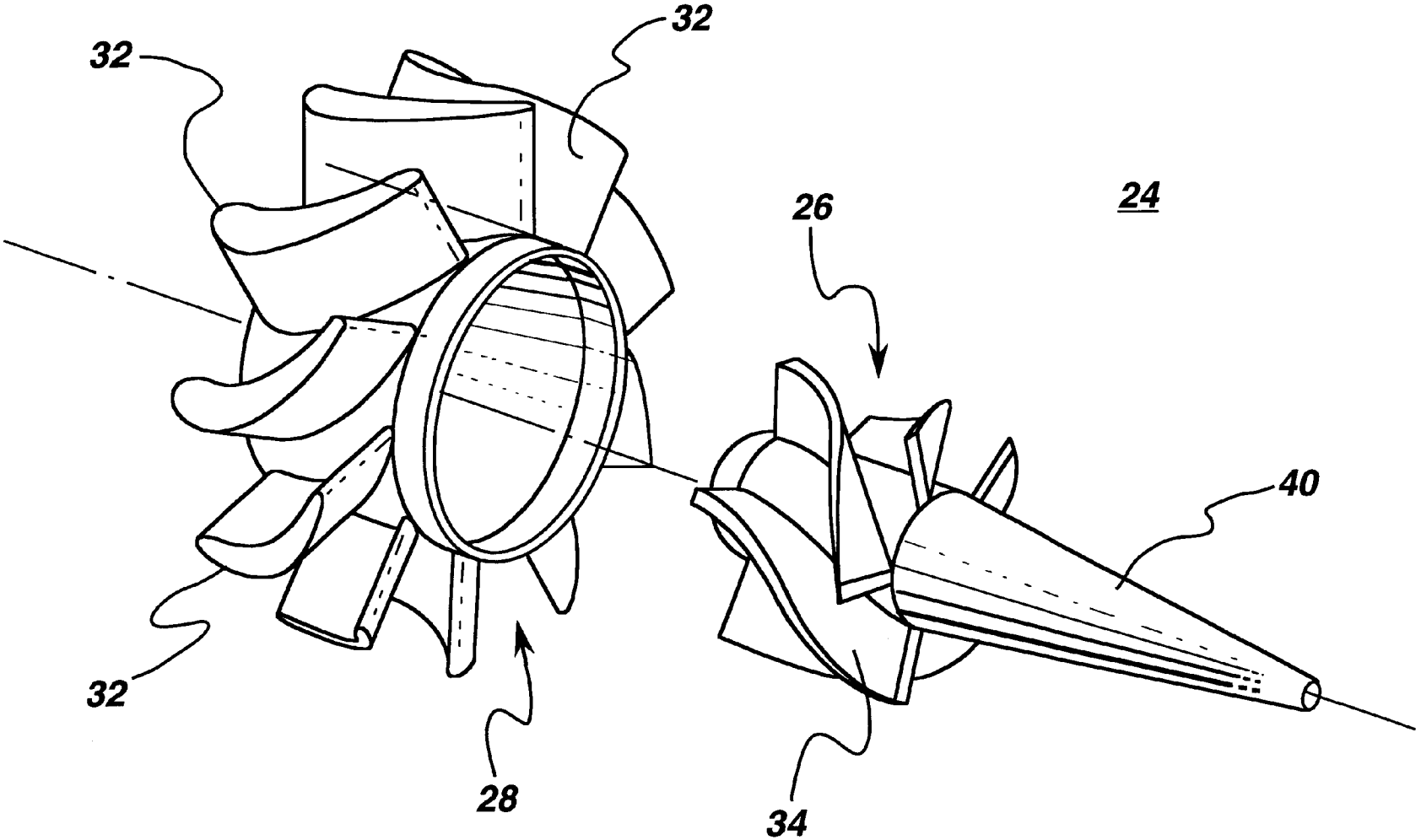
FIG. 2 is a perspective, exploded view of the outer and inner swirlers of the combustor shown in FIG. 1.
Figure 3:
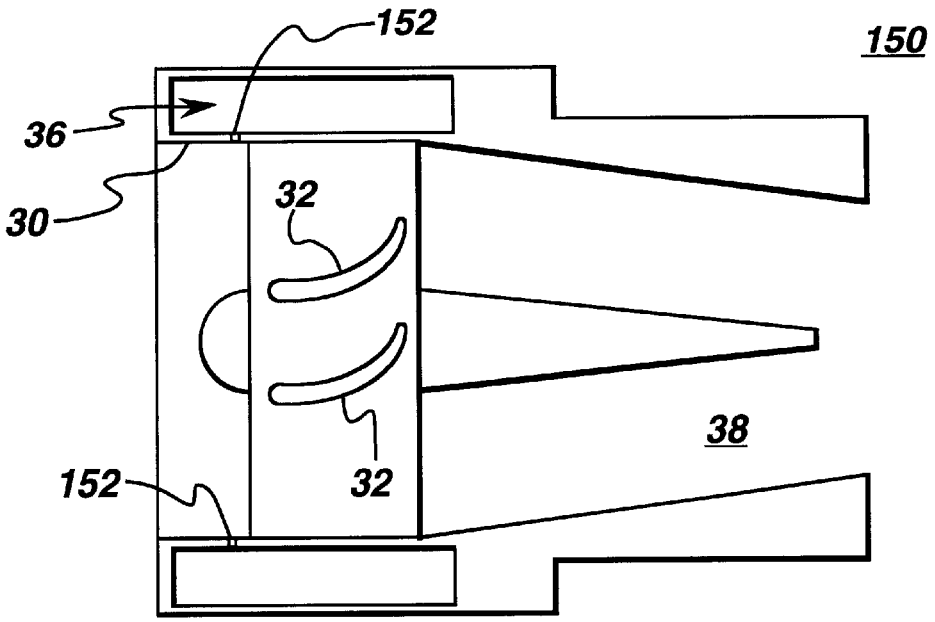
FIG. 3 is a schematic, partial cross sectional view through a combustor constructed in accordance with another embodiment of the present invention.

FIG. 3 is a partial, cross sectional view through a combustor 150 constructed in accordance with another embodiment of the present invention. With respect to combustor 150, components of combustor 150 which are identical to components of combustor 10 shown in FIGS. 1 & 2 are identified in FIG. 3 using the same reference numerals as used in FIGS. 1 & 2.

With respect to combustor 150, fuel injection openings 152 in shroud 30 provide communication between annular fuel chamber 36 and mixing duct 38. As shown in FIG. 3, fuel injection openings 152 are distributed about shroud 30 and are positioned upstream of swirl vanes 32. Accordingly, fuel is injected through fuel injection openings 152 at a location directly upstream of the leading edge of each outer swirl vane 32. In this embodiment, the fuel injection is upstream of swirl vanes 32, and correspondingly upstream of the pressure drop of the swirlers. Accordingly, this configuration provides-a longer mixing path for fuel/air mixing and provides reduced feedback to combustor noise as the fuel is injected upstream of the swirl vanes, and these vanes impede the transmission of noise from the combustor. Combustion dynamics (pressure oscillations driven by combustion) are increased by the responding oscillations in fuel flows. By sheltering the fuel injection from the combustor pressure oscillations, the fuel oscillations that drive combustion dynamics are reduced. The blockage created by the swirler vanes reduces the level of combustion driven pressure oscillations observed upstream of the swirl vanes. By injecting the fuel upstream of the swirl vanes, because of the reduced pressure oscillations in that region, the fuel flow oscillations are also reduced.

The use of solid vanes 32 within combustor 150 significantly reduces the fabrication time and costs associated with the mixer, and also significantly reduces the possibility for vane cracking, thereby improving the reliability of the mixer. In addition, by injecting fuel through fuel injection openings 152, the desired combustion performance and emission levels of such a mixer are achieved.

Figure 4:
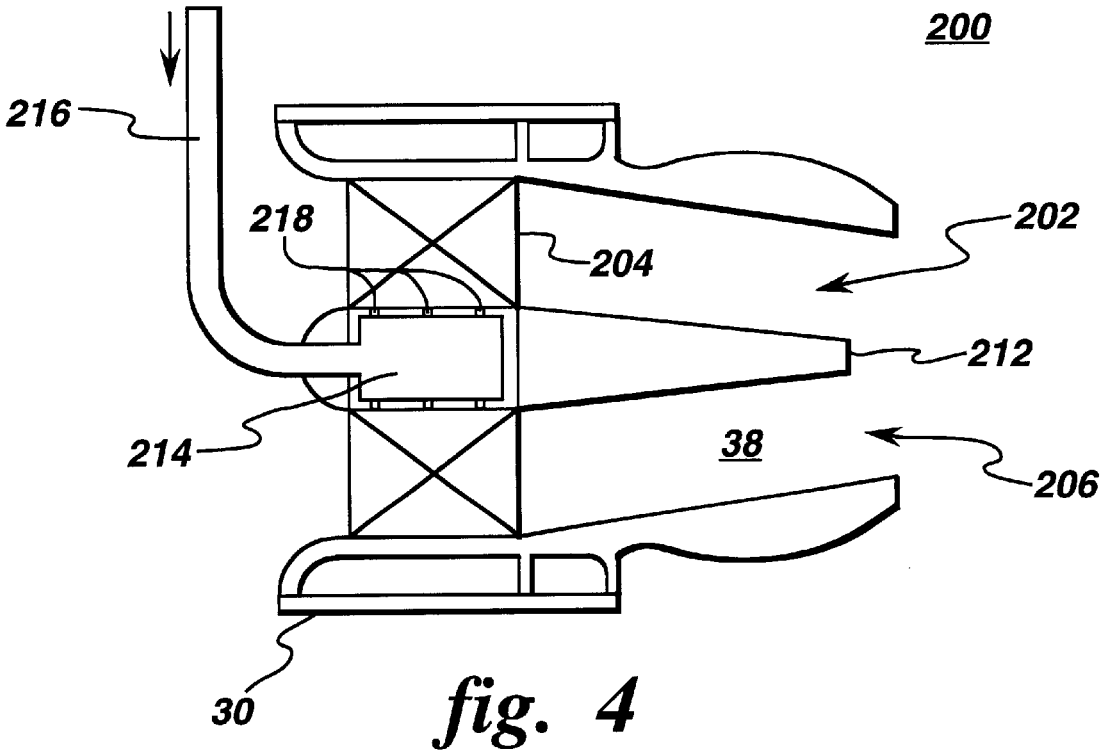
FIG. 4 is a schematic, partial cross-sectional view of a mixer constructed in accordance with yet another embodiment of the present invention.

FIG. 4 is a schematic, partial cross-sectional view of a combustor 200 constructed in accordance with yet another embodiment of the present invention. Combustor includes a mixer 202 including a single swirler 204 set in swirl cup 206. Swirler 204 includes vanes which are identical to vanes 32 of swirler 28 (FIG. 2). A shroud 30 surrounds mixer 202 at the upstream end. Downstream of swirler 204 is an annular mixing duct 38.

A centerbody 212 is provided in mixer 202, and centerbody 212 may be a straight cylindrical section or preferably one which converges substantially uniformly from its upstream end to its downstream end. Centerbody 212 is preferably cast within mixer 202 and is sized so as to terminate immediately prior to the downstream end of mixing duct 38. Centerbody 212 includes a fuel chamber 214 in flow communication with a fuel line 216. Fuel injection openings 218 in centerbody 212 are positioned between respective pairs of vanes 32 and extend from fuel chamber 214 into mixing duct 38. Fuel is injected through fuel injection openings 218 into mixing duct 38. The instant embodiment, for example, could be utilized in a single swirler configuration or in a double swirler configuration if the mass flow ratio was greater on the inner swirlers. This structure for injection also is flashback resistant compared to, for example, fuel pegs or the like. Additionally, the annular fuel manifold 36 (FIG. 1) is not required within this embodiment, so the overall construction is simplified.

As with the combustors described above, with combustor 200, use of solid vanes for swirler 204 significantly reduces the fabrication time and costs associated with the mixer, and also significantly reduces the possibility for vane cracking, thereby improving the reliability of the mixer. In addition, by injecting fuel through fuel injection openings 218, the desired combustion performance and emission levels of such a solid vane mixer are believed to be achieved.

Other embodiments and variations of the present invention are possible and contemplated. For example, in one embodiment, fuel injection openings in shroud 30 (FIG. 3)

are located between the leading edge of each pair of outer swirl vanes 32. Other embodiments include variations in the number of injection openings, the diameter of openings, and the spacing of the openings. In addition, the present invention can be utilized in connection with both dual fuel and single fuel mixers. Additionally, the instant invention may be utilized with premixers including one or two swirlers or the like.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A mixer for a combustor, said mixer comprising:

an annular mixing duct;

a swirler having a plurality of swirler vanes disposed at an upstream end of said duct; and a centerbody extending downstream from said vanes and having a downstream end terminating near an outlet of said duct, and having a fuel chamber disposed radially inwardly of said vanes and joined thereto in a unitary assembly, and fuel injection openings extending from said fuel chamber and opening into passages between said swirler vanes of said mixer;

wherein said fuel injection openings are arranged in groups of axially spaced apart ones thereof disposed between corresponding pairs of said vanes circumferentially around said fuel chamber.

2. A mixer in accordance with claim 1 further comprising a substantially annular shroud, said swirler located within said shroud, and said shroud having an annular leading edge defining an unobstructed annular inlet near leading edges of said vanes for receiving air.

3. A mixer in accordance with claim 1 wherein said plurality of vanes are solid vanes in a unitary casting with said centerbody.

4. A mixer according to claim 1 wherein each of said fuel injection opening groups includes a corresponding fuel injection opening circumferentially between said vanes near leading edges thereof.

5. A mixer according to claim 1 wherein each of said fuel injection opening groups includes three openings spaced apart axially between leading and trailing edges of said vanes.

6. A mixer according to claim 5 wherein ten of said vanes are circumferentially spaced apart around the circumference of said fuel chamber, with a total of thirty fuel injection openings extending therefrom.

7. A mixer according to claim 1 wherein said mixer comprises a single swirler.

8. A mixer according to claim 1 wherein said centerbody converges downstream from said vanes to said downstream end of said centerbody.

9. A mixer according to claim 8 wherein said mixing duct converges downstream from said vanes to said duct outlet.

10. A mixer for a combustor, said mixer comprising:

an annular mixing duct having axially opposite upstream and downstream ends, with said downstream end defining an outlet;

a swirler having a plurality of solid swirl vanes disposed at said duct upstream end; and a centerbody extending downstream from said vanes and having a downstream end terminating near said duct outlet, and having a fuel chamber disposed radially inwardly of said vanes and joined thereto in a unitary casting therewith, and a plurality of fuel injection openings extending from said fuel chamber into passages-between said swirler vanes;

wherein said fuel injection openings are arranged in groups of axially spaced apart ones thereof disposed between corresponding pairs of said vanes circumferentially around said fuel chamber.

11. A mixer according to claim 10 wherein said centerbody converges downstream from said vanes to said downstream end of said centerbody.

12. A mixer according to claim 11 wherein said mixing duct converges downstream from said vanes to said duct outlet.

13. A mixer according to claim 10 wherein each of said fuel injection opening groups includes a corresponding fuel injection opening circumferentially between said vanes near leading edges thereof.

14. A mixer according to claim 13 wherein each of said fuel injection opening groups includes three openings spaced apart axially between said vane leading edges and trailing edges of said vanes.

15. A mixer according to claim 14 wherein ten of said vanes are circumferentially spaced apart around the circumference of said fuel chamber, with a total of thirty fuel injection openings extending therefrom.

16. A mixer according to claim 14 wherein said mixer comprises a single swirler.

17. A mixer according to claim 14 further comprising a substantially annular shroud, said swirler located within said shroud, and said shroud having an annular leading edge defining an unobstructed annular inlet near said vane leading edges for receiving air.

* * * * *